United States Patent [19]

Gray

[11] 4,167,487

[45] * Sep. 11, 1979

[54] AROMATIC ACTIVATOR

[75] Inventor: Frederick W. Gray, Summit, N.J.

[73] Assignee: Colgate-Palmolive Company, New York, N.Y.

[ * ] Notice: The portion of the term of this patent subsequent to Feb. 8, 1989, has been disclaimed.

[21] Appl. No.: 475,817

[22] Filed: Jun. 3, 1974

Related U.S. Application Data

[63] Continuation of Ser. No. 367,995, Jun. 7, 1973, abandoned, which is a continuation of Ser. No. 138,373, Apr. 28, 1971, abandoned, which is a continuation-in-part of Ser. No. 828,782, May 28, 1969, Pat. No. 3,640,874.

[51] Int. Cl.[2] ..... C11D 7/54; C11D 3/395

[52] U.S. Cl. ..... 252/102; 8/111; 162/78; 252/95; 252/186; 252/99; 423/272; 424/130; 424/338

[58] Field of Search ..... 252/95, 99, 186, 102; 8/111; 162/78; 260/610 A; 423/272; 424/130, 338

[56] References Cited

U.S. PATENT DOCUMENTS

| | | | |
|---|---|---|---|
| 3,235,505 | 2/1966 | Tuvell | 252/135 |
| 3,595,798 | 7/1971 | Smith et al. | 252/95 |
| 3,640,874 | 2/1972 | Gray | 252/95 |
| 3,816,324 | 6/1974 | Fine et al. | 252/186 |

FOREIGN PATENT DOCUMENTS

| | | | |
|---|---|---|---|
| 844481 | 6/1970 | Canada | 252/102 |

*Primary Examiner*—Benjamin R. Padgett
*Assistant Examiner*—Irwin Gluck
*Attorney, Agent, or Firm*—Herbert S. Sylvester; Murray M. Grill; Norman Blumenkopf

[57] ABSTRACT

N-benzoyl 2-methyl-imidazole as an activator for peroxygen compounds for bleaching.

21 Claims, No Drawings

AROMATIC ACTIVATOR

This is a continuation of application Ser. No. 367,995 filed June 7, 1973 now abandoned, which in turn is a continuation of application Ser. No. 138,373 filed Apr. 28, 1971 now abandoned, which is a continuation-in-part of my copending application Ser. No. 828,782 filed May 28, 1969, now U.S. Pat. No. 3,640,874 whose entire disclosure is incorporated herein by reference.

In accordance with one aspect of this invention there are provided cleansing compositions, particularly useful for the removal of stains and the general cleaning of fabrics, containing N-benzoyl 2-methylimidazole and a peroxygen compound. The N-benzoyl 2-methylimidazole has good stability and is a particularly efficacious activator for the perborate.

The peroxygen compound is advantageously sodium perborate (e.g. sodium perborate tetrahydrate or monohydrate), sodium percarbonate or any of the other peroxygen compounds which are well known in the art, such as per-phosphates, urea-hydrogen peroxide, etc. It may be used in a mol ratio of active oxygen to activator of 1:1, or at lower or higher mol ratios, such as 0.5:1, 2:1, 4:1, 6:1, 8:1, 16:1. The amount of peroxygen compound may be varied; thus amounts representing some 2 to 60 parts per million of active oxygen in the wash solution may be used. For instance, a dry composition containing 10 to 20% of sodium perborate tetrahydrate may be added in amount of 1 gram per liter of water, thereby providing, respectively, 10 to 20 ppm of active oxygen.

The composition of peroxygen compound and activator may also contain a builder salt, such as a phosphate (e.g. pentasodium tripolyphosphate) or an aminocarboxylic acid salt such as trisodium nitrilotriacetate ("NTA") or tetrasodium salt of ethylene diamine tetraacetic acid. Other watersoluble builder salts are well known in the art. The proportion of builder salt may be varied, e.g. it may conveniently be as high as 60% of the total composition (such as 10 to 40%). Another suitable builder is trisodium citrate.

Other ingredients conventional in the fabric washing art may also be present in the composition. For instance proteolytic enzymes, or the well known water soluble organic detergents, antiredeposition agents such as sodium carboxymethyl cellulose, optical brighteners and corrosion inhibitors may be included.

The compositions of this invention may be used for presoaking clothes. In such soaking, unlike washing in a machine, the clothes and wash solution are generally substantially quiescent, there being little or no agitation of the fabrics, and the temperature is relatively low, below 110° F.; often for most of the soak period (which extends for well over an hour) the temperature is well below 100° F., e.g. 60°, 70° or 80° F.

The compositions may also be employed for washing clothes with agitation, as in automatic washing machines, at room temperature or at higher temperatures, e.g. 120° F. or higher.

The following Examples are given to illustrate this invention further. In the application all proportions are by weight unless otherwise indicated. In the Examples the pressures are substantially atmospheric unless otherwise indicated.

EXAMPLE 1

(Preparation of N-benzoyl-2-methylimidazole)

8.2 g (0.1 mol) of 2-methylimidazole (a pale yellow solid, 99% pure, m.p. 143°-144° C.) and 50 ml of tetrahydrofuran are placed in a flask. Over a 20 minute period, there is added gradually, with stirring, a solution of 7.0 g (0.05 mol) of benzoyl chloride in 25 ml of tetrahydrofuran. During this period the temperature of the contents of the flask, initially room temperature, rises owing to the exothermic reaction; the temperature of the contents of the flask is maintained at 40° C. by cooling. Stirring is continued, at 40° C., for 10 minutes. Then the mixture is refluxed (at 70° C.) for one hour. An oily layer separates. The mixture is cooled to solidify the oily material and the resulting precipitate is removed by filtration. After removal of tetrahydrofuran by evaporation under vacuum there remains 7.7 g of paste-like crude N-benzoyl 2-methylimidazole.

EXAMPLE 2

A composition containing 0.11 g of sodium percarbonate (of 13% active oxygen content), 0.186 g of the crude product of Example 1, 0.20 g of spray dried detergent particles (of the following constitution: 60% sodium linear dodecylbenzenesulfonate, 7.5% sodium silicate [of 1:2.35 $Na_2O:SiO_2$ ratio], about 1.3% $H_2O$ and the balance sodium sulfate, with a small amount of phenolic antioxidant) is added to 1 liter of water at a temperature of 120° F. and the resulting solution is placed along with three 3×6 inch coffee-tea stained cotton fabric swatches of predetermined reflectance (Rd) values, in a vessel (a Tergotometer) with agitation for 15 minutes while the temperature is maintained at 120° F. The swatches are then rinsed and dried and the Rd values again recorded on a Gardner Color Difference Meter and the average Δ Rd value is determined. A similar test is made with an identical composition except that no activator is present. The following results are obtained, using water of 100 ppm hardness calculated as calcium carbonate (the water is prepared by adding an appropriate amount of calcium chloride to distilled water):

| | Δ Rd |
|---|---|
| With product of Example 1 | 9.8 |
| Without activator | 0.4 |

The compositions of this invention may be modified, as by the inclusion of more or less alkaline ingredients to give different pH values on dissolution in water. Preferably the pH (on dissolution in water, at 0.1% to 0.2% concentration, say 0.15%) is at least 7 and less than 12, more preferably in the range of 8 to 10.

It is within the broader scope of the invention to use other activatable peroxy compounds; such compounds, e.g. urea hydrogen peroxide, are well known in the art. The cation of the peroxygen compound need not be sodium; it may, for example, be K, Ca, Mg or H.

It is also within the broader scope of the invention to replace all or part of the N-benzoyl 2-methylimidazole by N-m-chlorobenzoyl 2-methylimidazole (made in the same way as the N-benzoyl compound by substituting m-chlorobenzoyl chloride mol-for-mol for the benzoyl chloride in Example 1).

In some cases either the activator or the peroxygen compound or both may be suitably encapsulated (e.g. by means of a water-dispersible coating) to improve the storage stability of the composition with respect to moisture and other influences.

Typical anionic detergents are the alkylbenzenesulfonates having 10-16, e.g. 12, carbon atoms in the alkyl group particularly of the type described in U.S. Pat. No. 3,320,174, 16 May 1957 of J. Rubenfeld; the olefin sulfonates having 12 to 20, e.g. 16, carbon atoms particularly mixtures of alkenesulfonates and hydroxyalkanesulfonates obtained by reacting an alpha olefin with gaseous highly diluted $SO_3$ and hydrolyzing the resulting sultone-containing product, as by neutralizing with excess NaOH and heating to open the sultone ring; and the higher alkyl sulfates such as tallow alcohol sulfate. Most commonly these materials are employed as their sodium or other alkali metal salts, but ammonium or alkaline earth metal (e.g. magnesium salts) may be used. Mixture of various anionic detergents, e.g., a mixture of a sodium alkylbenzenesulfonate and a sodium olefin sulfonate may be employed.

Other anionic detergents are water-soluble soaps which may be used, alone or in combinations with other detergents. Examples of soaps are the sodium, potassium, etc. salts of fatty acids such as lauric, myristic, stearic, oleic, claidic, isostearic, palmitic, undecylenic, tridecylenic, pentadecylenic or other saturated or unsaturated fatty acid of 11 to 18 carbon atoms. Soaps of dicarboxylic acids may also be used such as the soaps of dimerized linoleic acid. Soaps of such other higher molecular weight acids such as resin or tall oil acids, e.g. abiotic acid, may also be employed. One specific suitable soap is the sodium soap of a mixture of tallow fatty acids and coconut oil fatty acids (e.g. in 3:1 ratio).

Suitable olefin sulfonate detergents and their preparation, are described in Rubinfeld et al U.S. Pat. Nos. 3,428,654 and 3,506,580 as well as in the references (dealing with olefin sulfonates) cited in those patents and in DiSalvo et al U.S. Pat. No. 3,420,875. Generally the olefin sulfonates also contain small amounts (e.g. 1 to 15%) of disulfonates formed during the sulfonation reaction. The olefin sulfonates may be produced from alpha-olefins, internal olefins, or 2,2-dialkylethylenes (having a vinylidene group) or from mixtures thereof as described in the aforementioned DiSalvo patent.

Another suitable anionic detergent is an alkyl phenol disulfonate such as one having an alkyl group having some 12 to 25 carbon atoms, preferably about 16 to 22 and more preferably about 18 to 20 carbon atoms. The alkyl group is preferably of the linear biodegradable type; one preferred type is produced by alkylation of a phenol with an alpha olefin (such as a linear unbranched alpha olefin) and may have a primary or a secondary alkyl group, e.g. an alkyl group attached to the benzene ring at a point one, two, three or four carbon atoms from a terminal methyl group. In one typical material about 10–15% of the alkyl groups are attached at the 2-position of the alkyl groups and the balance randomly at the 3, 4, 5, etc. positions and the alkyl group is for instance, in the ortho position with respect to the phenolic hydroxyl group; or the material may be a mixture of o-alkyl species with p-alkyl species. The alkyl phenol may be sulfonated in conventional manner in oleum (e.g. containing 15%, 20%, 25% or 50% $SO_3$) using sufficient oleum to (e.g. 1.2 to 1.5, such as 1.3, parts of 20% oleum per part of alkyl phenol) to produce a product containing in excess of 1.6, preferably above 1.8 (e.g. 1.8 to 1.9 or 1.95) $SO_3H$ groups per alkyl phenol molecule. The disulfonate may be one whose phenolic hydroxyl group is blocked, as by etherification or esterification; thus the H of the phenolic OH may be replaced by an alkyl (e.g. ethyl) or hydroxyalkoxyalkyl (e.g. $—(CH_22CH_2O)_xH$ group in which x is one or more, such as 3, 6 or 10; and the resulting alcoholic OH may be esterified to form, say, a sulfate, e.g. $—SO_3Na$).

Other suitable anionic detergents are the paraffin sulfonates, such as the reaction products of alpha olefins and bisulfites (e.g. sodium bisulfite), for instance, the primary paraffin sulfonates of about 10-20, preferably about 15 to 20 carbon atoms.

Other suitable anionic detergents are sulfates of higher alcohols, such as sodium lauryl sulfate, sodium tallow alcohol sulfate, Turkey Red Oil or other sulfated oils, or sulfates of mono- or diglycerides of fatty acids (e.g. stearic monoglyceride monosulfate), alkyl poly (ethenoxy) ether sulfates such as the sulfates of the condensation products of ethylene oxide and lauryl alcohol (usually having 1 to 5 ethenoxy groups per molecule); lauryl or other higher alkyl glyceryl ether sulfonates; aromatic poly (ethenoxy) ether sulfates such as the sulfates of the condensation products of ethylene oxide and nonyl phenol (usually having 1 to 20 oxyethylene groups per molecule preferably 2–12).

The suitable anionic detergents include also the acyl sarcosinates (e.g. sodium lauroylsarcosinate) the acyl esters (e.g. oleic acid ester) of isothionates, and acyl N-methyl taurides (e.g. potassium N-methyl lauroyl-or oleyl tauride).

The most highly preferred water soluble anionic detergent compounds are the ammonium and substituted ammonium (such as mono-, di- and triethanolamine), alkali metal (such as sodium and potassium) and alkaline earth metal (such as calcium and magnesium) salts of the higher alkyl benzene sulfonates, olefin sulfonates, paraffin sulfonates, alkyl phenol disulfonates, the higher alkyl sulfates, and the higher fatty acid monoglyceride sulfates. The particular salt will be suitably selected depending upon the particular formulation and the proportions therein.

Nonionic surface active agents include those surface active or detergent compounds which contain an organic hydrophobic group and a hydrophilic group which is a reaction product of a solubilizing group such as carboxylate, hydroxyl, amide or amine with ethylene oxide or with the polyhydration product thereof, polyethylene glycol.

As examples of nonionic surface active agents which may be used there may be noted the condensation products of alkyl phenols with ethylene oxide, e.g., the reaction product of isoctyl phenol with about 6 to 30 ethylene oxide units; condensation products of alkyl thiophenols with 10 to 15 ethylene oxide units; condensation products of higher fatty alcohols such as tridecyl alcohol with ethylene oxide; ethylene oxide addends of monoesters of hexahydric alcohols and inner ethers thereof such as sorbitan monolaurate, sorbitol monooleate and mannitan monopalmitate, and the condensation products of polypropylene glycol with ethylene oxide.

As indicated above, the compositions may contain an enzyme such as a proteolytic enzyme which is active upon protein matter and catalyzes digestion or degradation of such matter when present as in linen or fabric stain in a hydrolysis reaction. The enzymes may be effective at a pH range of say about 4–12, and may be effective even at moderately high temperatures so long as the temperature does not degrade them. Some proteolytic enzymes are effective at up to about 80° C. and higher. They are also effective at ambient temperature and lower to about 10° C. Particular examples of proteolytic enzymes which may be used in the instant invention include pepsin, trypsin, chymotrypsin, papain, bromelin, colleginase, keratinase, carboxylase, amino peptidase, elastase, subtilisia and aspergillopepidase A and B. Preferred enzymes are subtilisin enzymes manufactured and cultivated from special strains of spore forming bacteria, particularly Bacillus subtilis.

Proteolytic enzymes such as Alcalase, Maxatase, Protease AP, Protease ATP 40, Protease ATP 120, Protease L-252 and Protease L-423 are among those enzymes derived from strains of spore foaming bacillus, such as Bacillus subtillis.

Different proteolytic enzymes have different degrees of effectiveness in aiding in the removal of stains from textiles and linen. Particularly preferred as stain removing enzymes are subtilisin enzymes.

Metalloproteases which contain divalent ions such as Calcium, magnesium or zinc bound to their protein chains are of interest.

The production of various proteolytic enzyme concentrates is described in the patent literature: for example in German Offenlegenschrift No. 1,800,508 and in published Dutch patent application No. 6,815,944.

Instead of, or in addition to, the proteolytic enzyme, an amylase may be present such as a bacterial amylase of the alpha type (e.g. obtained by fermentation of B. subtilis). One very suitable enzyme mixture contains both a bacterial amylase of the alpha type and an alkaline protease, preferably in proportions to supply about 100,000 to 400,000 Novo alpha-amylase units per Anson unit of said alkaline protease.

The enzyme preparation may be incorporated as a powdered salt-containing product, or as a product containing little or no salt. It may be present in the dry mixture in the form of tiny spheroidal beads containing enzyme encapsulated in solidified molten nonionic detergent and containing say 0.1 to 3 Anson units of protease per gram of said beads, the amount thereof being such as to provide about 0.001 to 0.1 Anson units per liter of wash solution, e.g. 0.001 to 0.1 Anson unit per gram of the whole activator-containing composition.

The brighteners may be of conventional type. For instance, in the foregoing Example 2 the composition may contain a mixture of the following: (a) a naphthotriazole stilbene sulfonate brightener, sodium 2-sulfo-4 (2-naphtho-1,2-triazolyl) stilbene, (b) another stilbene brightener, bis (anilino diethanolamino triazinyl) stilbene disulfonic acid, (c) another stilbene brightener, sodium bis (anilino morpholinotriazinyl) stilbene disulfonate, and (d) an oxazole brightener, having a 1-phenyl 2-benzoxazole ethylene structure, 2-styryl naphtha [1, 2 d] oxazole, in the relative proportions, a:b:c:d, of about 1:1:3:1.2, the total amount of brighteners being, for instance, about equal to half the total amount of active oxygen represented by the peroxygen compound.

Cationic surface active agents may also be included, e.g. surface active detergent compounds which contain an organic hydrophobic group and a cationic solubilizing group. Typical cationic solubilizing groups are amino and as quaternary groups.

As examples of suitable synthetic cationic detergents there may be noted the diamines such as those of the type $RNHC_2H_4NH_2$ wherein R is an alkyl group of about 12 to 22 carbon atoms such as N-2-aminoethyl stearyl amine and N-2-aminoethyl myristyl amine; amido-linked amines such as those of the type $R^1CONHC_2H_4NH_2$ wherein R′ is an alkyl group of about 9 to 20 carbon atoms, such as N-2-amino ethylstearyl amide and N-amino ethyl myristyl amide; quaternary ammonium compounds wherein typically one of the groups linked to the nitrogen atom are alkyl groups which contain 1 to 3 carbon atoms, including such 1 to 3 carbon alkyl groups bearing inert substituents, such as phenyl groups, and there is present an anion such as halogen, acetate, methosulfate, etc. Typical quaternary ammonium detergents are ethyl-dimethyl-stearyl ammonium chloride, benzyl-dimethyl-stearyl ammonium chloride, benzyl-dimethyl-stearyl ammonium chloride, trimethyl stearyl ammonium chloride, trimethyl-cetyl ammonium bromide, dimethylethyl dilauryl ammonium chloride, dimethyl-propyl-myristyl ammonium chloride, and the corresponding methosulfates and acetates.

Amphoteric detergents may also be included. Examples of these are N-alkyl-beta-aminopropionic acid; N-alkyl-betaimino-dipropionic acid, and N-alkyl, N,N-dimethyl glycine; the alkyl group may be, for example, that derived from coco fatty alcohol, lauryl alcohol, myristyl alcohol (or a laurylmyristyl mixture), hydrogenated tallow alcohol, cetyl, stearyl, or blends of such alcohols. The substituted aminopropionic and iminodipropionic acids are often supplied in the sodium or other salt forms, which may likewise be used in the practice of this invention. Examples of other amphoteric detergents are the fatty imidazolines such as those made by reacting a long chain fatty acid (e.g. of 10 to 20 carbon atoms) with diethylene triamine and monohalocarboxylic acids having 2 to 6 carbon atoms, e.g. 1-coco-5-hydroxyethyl-5-carboxymethylimidazoline; betaines containing a sulfonic group instead of the carboxylic group; betaines in which the long chain substituent is joined to the carboxylic group without an intervening nitrogen atom, e.g. inner salts of 2-trimethylamino fatty acids such as 2-trimethylaminolauric acid, and compounds of any of the previously mentioned types but in which the nitrogen atom is replaced by phosphorous.

It is understood that the foregoing detailed description is given merely by way of illustration and that variations may be made therein without departing from the spirit of the invention. The "Abstract" given above is merely for the convenience of technical searchers and is not to be given any weight with respect to the scope of the invention.

I claim:

1. A method for activating an inorganic, water soluble peroxygen compound comprising dissolving said peroxygen compound in water and contacting the dissolved peroxygen compound with N-benzoyl 2-methylimidazole or N-m-chlorobenzoyl 2-methylimidazole, in an amount sufficient to provide a mol ratio of active oxygen of said peroxygen compound to activator of about 0.5:1 to 16:1.

2. A method as in claim 1 in which said peroxygen compound is selected from the group consisting of sodium perborate and sodium percarbonate.

3. A composition for the cleaning of fabrics consisting essentially of an inorganic, water soluble peroxygen compound and as an activator therefor N-benzoyl 2-methylimidazole or N-m-chlorobenzoyl 2-methylimidazole, the mol ratio of active oxygen of said peroxygen compound to activator being 0.5:1 to 16:1.

4. A composition as in claim 3 having a pH, on dissolution in water, at 0.15% concentration, in the range of 8 to 10.

5. A composition as in claim 4 containing trisodium citrate.

6. A composition as in claim 4 containing trisodium nitrilotriacetate.

7. A composition as in claim 4 containing tetrasodium salt of ethylene diamine tetraacetic acid.

8. A composition as defined in claim 3 wherein said activator is N-benzoyl-2-methylimidazole.

9. A composition as defined in claim 3 wherein said activator is N-m-chlorobenzoyl-2-methylimidazole.

10. A composition as defined in claim 3 wherein said mol ratio is at least about 2:1.

11. A process which comprises contacting fabrics in an aqueous medium with the composition of claim 3.

12. A bleaching composition consisting essentially of a hydrogen peroxide releasing inorganic persalt, and an activating amount of 1-benzoyl-2-methylimidazole, said activating amount being about 1 to 2 equivalents for each equivalent of the hydrogen peroxide releasing compound.

13. The composition of claim 12 wherein said persalt is an alkali-metal persalt.

14. The composition of claim 13 wherein the mol ratio of the imidazole to the persalt is about 1:1.

15. The composition of claim 12 comprising the persalt sodium perborate.

16. A process for bleaching fabrics which comprises contacting said fabrics in an aqueous medium with the composition of claim 12.

17. A bleaching composition consisting essentially of hydrogen peroxide or a hydrogen peroxide releasing compound selected from the group consisting of organic peroxides and inorganic persalts; and an activating amount of 1-benzoyl-2-methylimidazole, the activating amount of the 1-benzoyl-2-methylimidazole in the composition being at least one equivalent of the 1-benzoyl-2-methylimidazole for each equivalent of the hydrogen peroxide releasing compound.

18. The composition of claim 17 wherein the hydrogen peroxide releasing compound is an alkali-metal persalt.

19. The composition of claim 18 wherein the mole ratio of the imidazole to the persalt is about 1:1.

20. The composition of claim 17 comprising the persalt sodium perborate.

21. A process for bleaching fabrics which comprises contacting said fabrics in an aqueous medium with the composition of claim 17.

* * * * *